US010852082B1

(12) United States Patent
Pierce

(10) Patent No.: US 10,852,082 B1
(45) Date of Patent: Dec. 1, 2020

(54) BACKWARD SWEPT MAGAZINE FOR PISTOL

(71) Applicant: U.S. Government as Represented by the Secretary of the Army, Dover, NJ (US)

(72) Inventor: Bradley Pierce, Kailua, HI (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/387,683

(22) Filed: Apr. 18, 2019

Related U.S. Application Data

(60) Provisional application No. 62/659,808, filed on Apr. 19, 2018.

(51) Int. Cl.
*F41A 3/66* (2006.01)
*F41A 9/65* (2006.01)

(52) U.S. Cl.
CPC . *F41A 3/66* (2013.01); *F41A 9/65* (2013.01)

(58) Field of Classification Search
CPC ..... F41A 9/65; F41A 9/70; F41A 3/66
USPC ..... 42/7, 50, 69.02
See application file for complete search history.

(56) References Cited

U.S. PATENT DOCUMENTS

| | | | | |
|---|---|---|---|---|
| 930,865 | A * | 8/1909 | Keith et al. | F41A 19/30 89/145 |
| RE26,872 | E * | 4/1970 | Dieckmann | F41A 3/12 89/195 |
| 3,893,369 | A | 7/1975 | Benelli | |
| 6,212,991 | B1 * | 4/2001 | Frazier, III | F41A 3/82 42/16 |
| 7,941,958 | B1 * | 5/2011 | Zedrosser | F41A 3/66 42/75.01 |
| 8,061,255 | B1 | 11/2011 | Boberg | |
| 8,356,543 | B2 | 1/2013 | Rosol | |
| 2010/0242329 | A1 * | 9/2010 | Carr | F41C 23/10 42/14 |

* cited by examiner

*Primary Examiner* — Stephen Johnson
(74) *Attorney, Agent, or Firm* — John P. DiScala

(57) ABSTRACT

A pistol with a magazine angle swept backward in relation to the barrel increases the barrel length for a given pistol length without deviating from the grip ergonomics of conventional modern pistols. By angling the magazine in this manner, the muzzle velocity of a pistol may be increased for a given pistol length. Alternatively, the pistol length may be minimized for a given muzzle velocity.

16 Claims, 11 Drawing Sheets

BACKWARD SWEPT MAGAZINE FOR PISTOL

CROSS-REFERENCE TO RELATED APPLICATIONS

This application claims the benefit under 35 USC § 119(e) of U.S. provisional patent application 62/659,808 filed on Apr. 19, 2018.

STATEMENT OF GOVERNMENT INTEREST

The inventions described herein may be manufactured, used and licensed by or for the United States Government.

FIELD OF THE INVENTION

The invention relates in general to firearms and in particular to pistols.

BACKGROUND OF THE INVENTION

Pistols are a popular firearm with applications for military, law enforcement, sporting and self-defense. This popularity can partly be attributed to the relatively compact size and portability of pistols.

There are concessions associated with the portability of pistols, however. Namely, the muzzle velocity of a pistol is highly dependent on barrel length of the pistol. However, barrel length is constrained by the overall length of a pistol. Therefore a tradeoff exists between muzzle velocity and pistol length as a beneficial change in one may adversely affect the other. A pistol with a high muzzle velocity may limit the portability of the pistol or increase the pistol length to an impractical size. Alternatively, a pistol with a limited overall length may lack the muzzle velocity to be effective in certain applications.

A need exists for a pistol which maximizes muzzle velocity for a given overall pistol length or minimizes overall pistol length for a given muzzle velocity. Further, the public has become accustomed to the shape and orientation of the modern pistol grip. Modifications to the pistol grip may be met with wariness by users. The ergonomics of such a pistol should be substantially similar to conventional modern pistols.

SUMMARY OF INVENTION

One aspect of the invention is a pistol with a magazine angle swept backward in relation to the barrel increases the barrel length for a given pistol length without deviating from the grip ergonomics of conventional modern pistols. By angling the magazine in this manner, the muzzle velocity of a pistol may be increased for a given pistol length. Alternatively, the pistol length may be minimized for a given muzzle velocity.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
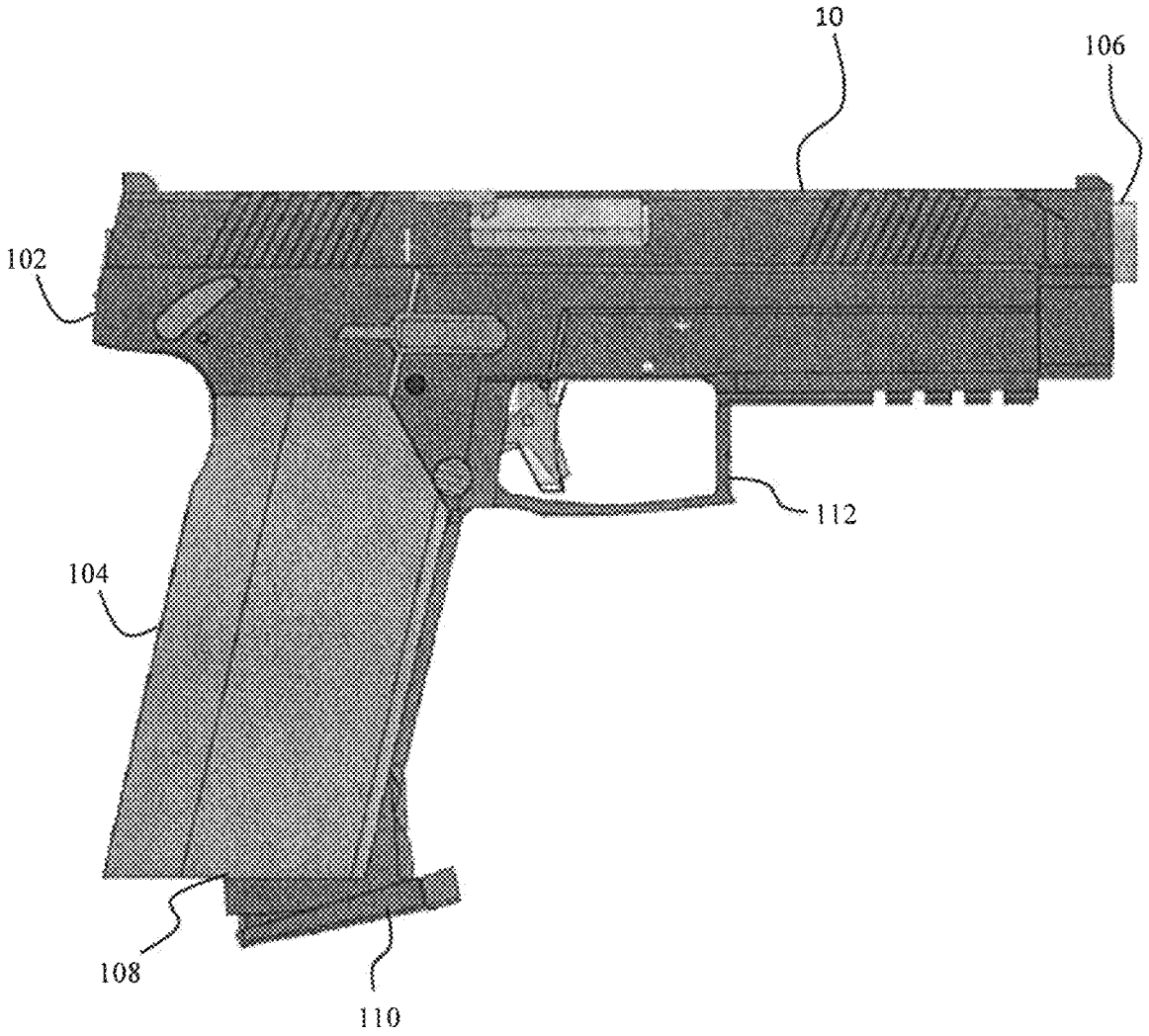
FIG. 1 is a right side view of a pistol with a backward swept magazine, in accordance with one illustrative embodiment.

A pistol with a magazine well swept backward relative to the angle of the pistol grip provides either increased performance or increased portability without deviating from the grip ergonomics of conventional modern pistols. By angling the magazine well in this manner, the barrel length of a pistol may be increased in relation to the overall pistol length which in turn increases the muzzle velocity of the pistol in relation to conventional modern pistols of the same length with a forward swept magazine. Alternatively, angling the magazine backward allows for a shorter minimum pistol length for a desired muzzle velocity when compared to conventional modern pistols with a forward swept magazine.

The angle and position of the magazine well is chosen such that a magazine inserted into the pistol will fit within the profile of conventional forward swept modern grips. Accordingly, the pistol will provide users with a seamless ergonomic experience consistent with user expectations when compared to conventional pistols. Additionally, the loading angle of the ammunition remains substantially similar to conventional modern pistols thereby negating the need for any exotic feed mechanisms.

The pistol further includes an improved trigger assembly as a result of the backward swept magazine. As the top of the angled magazine in the pistol with backward swept magazine occupies the interior space typically occupied by the trigger assembly in a conventional modern pistol, the trigger assembly in the pistol with backward swept magazine is located in a space more proximate to the trigger. In conventional pistols with a forward swept magazine, this space is typically occupied by the inserted magazine. In the present pistol, the increased proximity between the trigger and the remaining trigger assembly components allows for a less complicated trigger assembly.

The firing mechanism utilizes a dual striker system. The dual striker system provides a means for a dual mode trigger. The trigger may function in either a long action mode or a single action mode. In an embodiment, the dual mode trigger functions as a long action trigger on an initial pull thereby providing a "heavy" feel and as a single action for subsequent pulls.

The pistol includes a rotating barrel short recoil action. The rotating barrel includes a chamber indicator designed for the rotating barrel. The chamber indicator provides indication of chambered round to a user looking down the pistol sights. The chamber indicator is designed to mitigate risk of snags.

Having a rearward magazine angle also allows for equal or greater speed in reloading magazines. When a shooter begins to reload and holds a new magazine in his non-dominant hand and the pistol at an upward angle in the other, a straight line is made from the new magazine with the shooter's wrist, forearm, and elbow. This makes the placing of the magazine into the empty magazine well more natural.

Additionally, due the rearward movement of the non-dominant arm after putting the new magazine into the magazine well, the shooter is able to continue that rearward movement naturally to grab the slide and pull it rearward which drops the slide lock. The shooter can then let go of the slide which returns forward under spring pressure, chambering a new round. The shooter then resumes a proper shooting grip. Known as the "slingshot" method of reloading, this method is often preferred to depressing the slide lock manually after loading a new magazine as the slide lock can be difficult to manipulate under stressful situations where speed is critical. This novel magazine angle allows the slingshot technique to be more natural therefore making the shooter more effective with the handgun.

Figure 2:
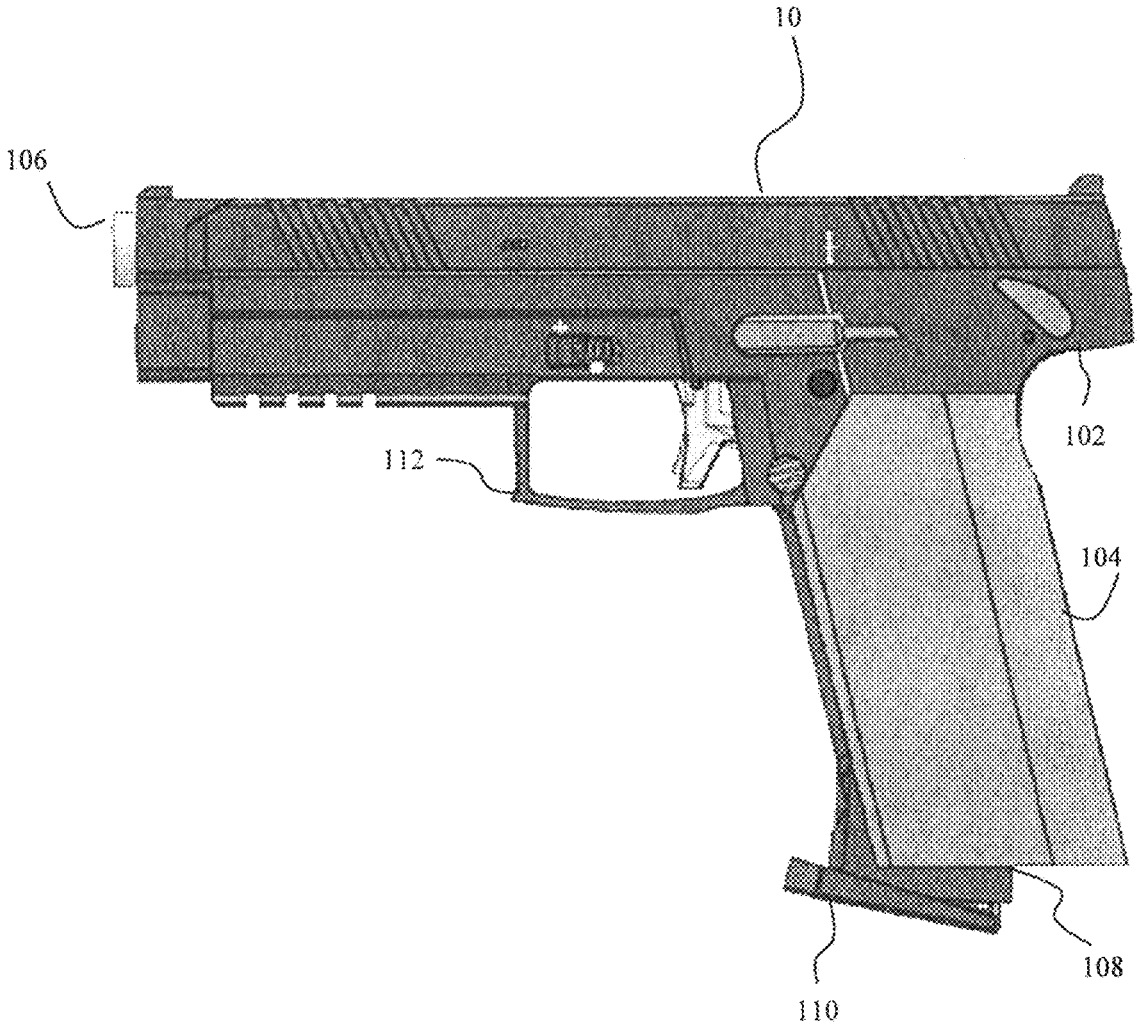
FIG. 2 is a left side view of a pistol with a backward swept magazine, in accordance with one illustrative embodiment.

FIG. 1 is a right side view of a pistol with a backward swept magazine, in accordance with one illustrative embodiment. FIG. 2 is a left side view of a pistol with a backward swept magazine, in accordance with one illustrative embodiment.

The pistol 10 comprises a frame 102 further comprising a grip 104. The grip 104 is forward swept with respect to a barrel 106 of the pistol 10 as in a conventional modern pistol. That is to say that a bottom portion of the grip 104, a distal end of the grip 104, is angled away from a muzzle of the pistol 10. A proximate end of the grip 104 is forward the distal end of the grip 104. The pistol 10 further comprises a magazine well 108 contained substantially within an interior cavity of the grip 104 and having an opening configured for receiving an ammunition magazine 110. However, in contrast to conventional pistols, the magazine well 108 is backward swept with respect to the barrel 106 of the pistol 10. A distal end of the magazine well 108 is angled away from the rear of the pistol 10 and toward the barrel 106. A proximate end of the magazine well 108 is backward the distal end of the magazine well 108.

In an embodiment of the invention, the angle formed between the magazine well 108 and the barrel 106 is 88 degrees. However, the magazine well 108 is not limited to an angle of 92 degrees relative to the horizontal axis. The magazine well angle may be increased or decreased depending on the needs of the application.

The magazine well 108 is sized and dimensioned to receive a standard magazine 110 which when inserted is substantially within the magazine well 108 and therefore within the confines of the pistol grip 104. The portions of the grip 104 proximate to the trigger well 112, which receive the palm and non-trigger digits of the user, retain a similar profile to a conventional modern pistol.

Figure 3:
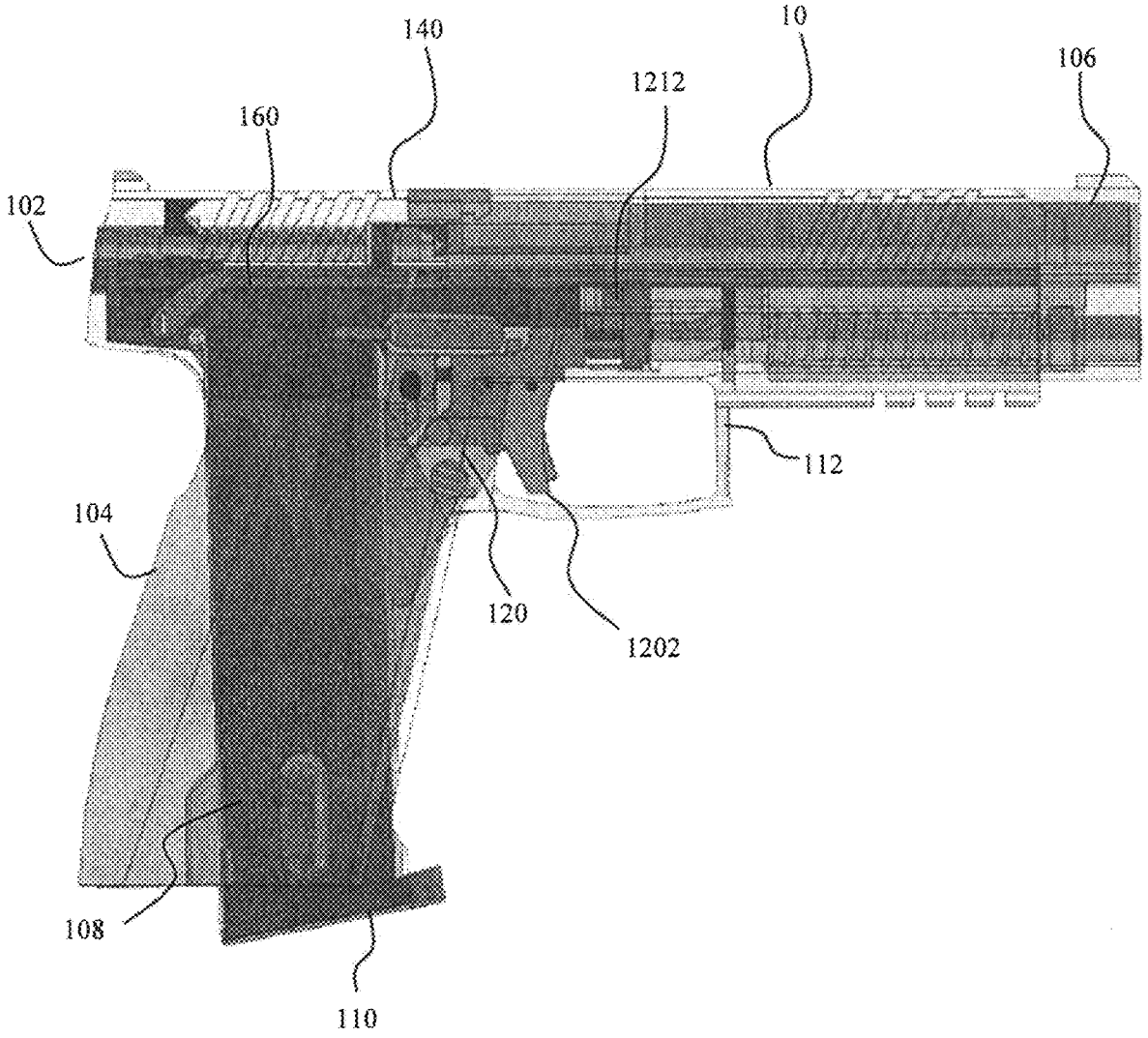
FIG. 3 is a left side view of a pistol with a backward swept magazine with the frame shown removed to show the internal mechanisms of the pistol, in accordance with one illustrative embodiment.
Figure 4:
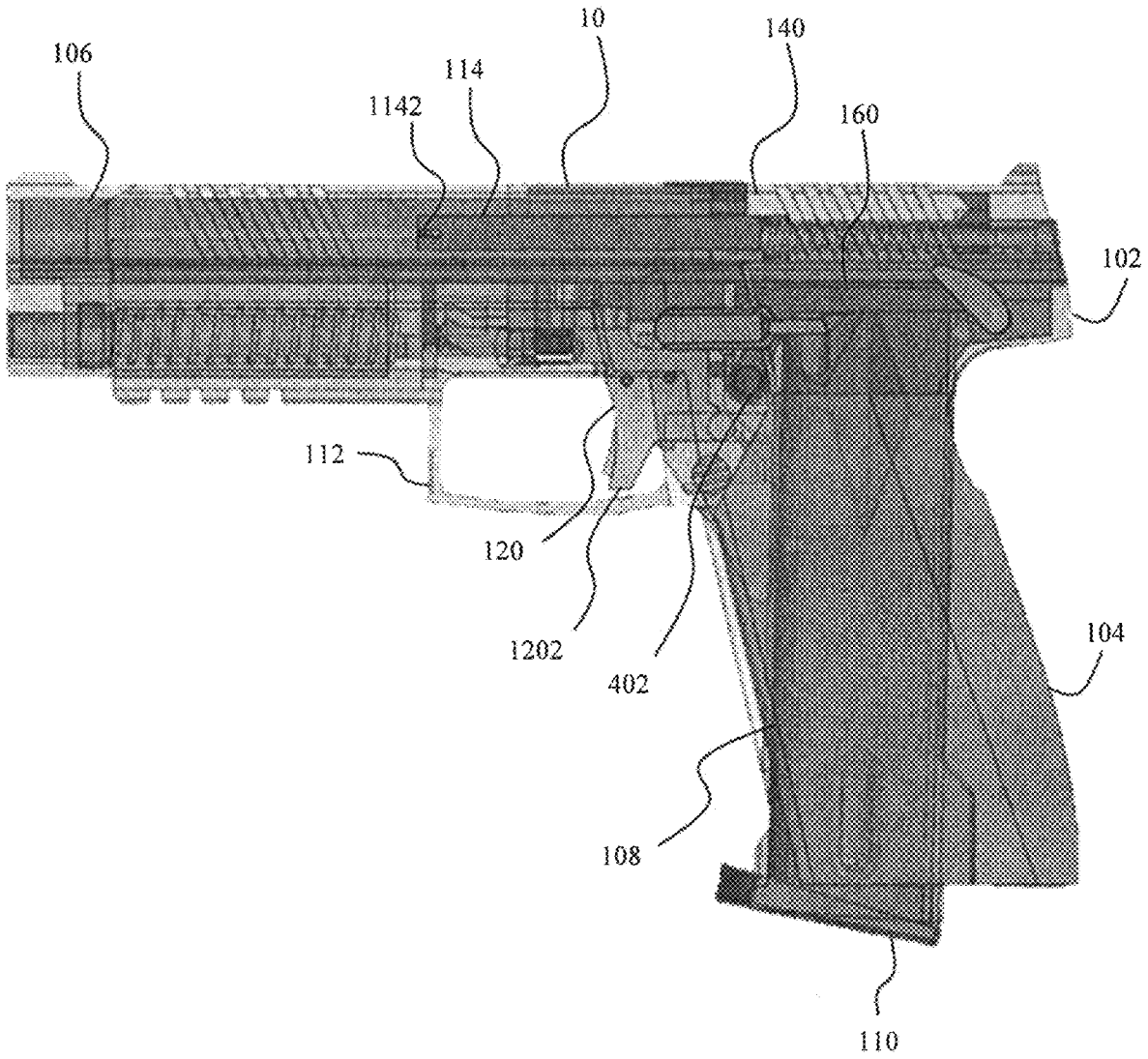
FIG. 4 is a back isometric view of the striker assembly of the pistol illustrating the striker operation, in accordance with an illustrative embodiment.

FIG. 3 is a right side view of a pistol with a backward swept magazine with the frame shown transparency to show the internal mechanisms of the pistol, in accordance with one illustrative embodiment. FIG. 4 is a left side view of a pistol with a backward swept magazine with the frame shown transparency to show the internal mechanisms of the pistol, in accordance with one illustrative embodiment.

The magazine well 108 is positioned within the frame 102 of the pistol 10 such that the inserted magazine 110 has an opening within the frame 102 of the pistol 10 further to the rear, or back, of the pistol 10 in relation to a conventional modern pistol of similar length. Accordingly, a breech end of the barrel 106 may also be positioned closer to the rear of the pistol 10 in relation to a conventional modern pistol. This allows for either a longer barrel or a shorter pistol length depending on the desired attribute of the pistol 10.

The backward magazine angle will also improve reliability as the round in the magazine 110 may be angled up higher allowing it to be pushed straight into the chamber without the need for a feed ramp. This helps solve the issue of hollow point bullets and other blunt nose bullets from jamming on the feed ramp since their blunt noses can catch on the receiver preventing chambering.

The pistol 10 comprises a firing mechanism which in turn comprises a trigger assembly 120, a striker assembly 140 and a release assembly 160. In contrast to conventional modern pistols, certain components of the trigger assembly 120 are positioned behind the trigger itself 1202. The backward swept magazine well 108 does not occupy the interior space behind the trigger as is the case with a conventional pistol thereby allowing for these components to be positioned there. In contrast, the top end of the backward swept magazine well 108 is positioned behind the barrel 106 in the space traditionally occupied by the firing mechanisms.

Advantageously, components of the trigger assembly 120 are located behind the trigger in the space which is typically occupied by a forward swept magazine instead of having to wrap around the magazine. For example, the trigger assembly 120 comprises a single cross pin in place of the multiple cross pins in conventional modern pistols.

By placing the rest of the trigger assembly 120 closer to the trigger 1202, the trigger assembly 120 is also able to interact more intimately with the trigger 1202 which increases the functionality of the trigger 1202 and reduces the complexity and number of parts in the mechanism.

As will be described in further detail below, the trigger assembly includes a trigger sear 1212 which engages the release assembly 160 to enable firing.

The pistol 10 utilizes a rotating barrel short recoil action with novel geometry. The rotating barrel 106 is designed to operate with the internal layout of the pistol 10. More specifically, the locking surfaces and camming surfaces are sized and dimensioned to interface with corresponding portions of the pistol 10.

The pistol 10 further comprises a chamber indicator 114 for providing visual indication that a round is located in the chamber. The chamber indicator 114 was particularly designed to operate in conjunction with the rotating barrel 106. The chamber indicator 114 extends along the side of the slide. When a round is chambered in the pistol 10, a portion of the chamber indicator 114 is pressed outward from the pistol 10 thereby causing a protrusion 1142 to extend beyond the outer surface of the slide. The protrusion 1142 provides visual indication that a round is in the chamber. The chamber indicator 114 is made out of spring steel and deforms only if a force is applied to it. The chamber indicator 114 retracts under spring tension when a round is not chambered thereby minimizing the risk of snagging. The location of the protrusion 1142 sticking out of the slide means that the shooter will know that there is a round in the chamber when looking down the sights.

Further, to improve safety, a slide 116 of the pistol 10 may be removed from the frame 102 without the user having to depress the trigger 1202. To remove the slide from the frame 102, the slide is pulled maximally to the rear and a disassembly button located on the left side of the pistol 10 is depressed inward. As will be described in further detail below, the motion of the disassembly button simultaneously causes a barrel block to move forward and out of line with a barrel cam and restricts the operation of the release assembly 160 and striker assembly. This allows the striker to be taken off the frame 102 without the need to pull the trigger 1202. The slide is then reinserted onto the frame 102 by aligning the rails of the slide with the frame 102 and pulling it to the rear position whereby the disassembly button will disengage in response.

Figure 5:
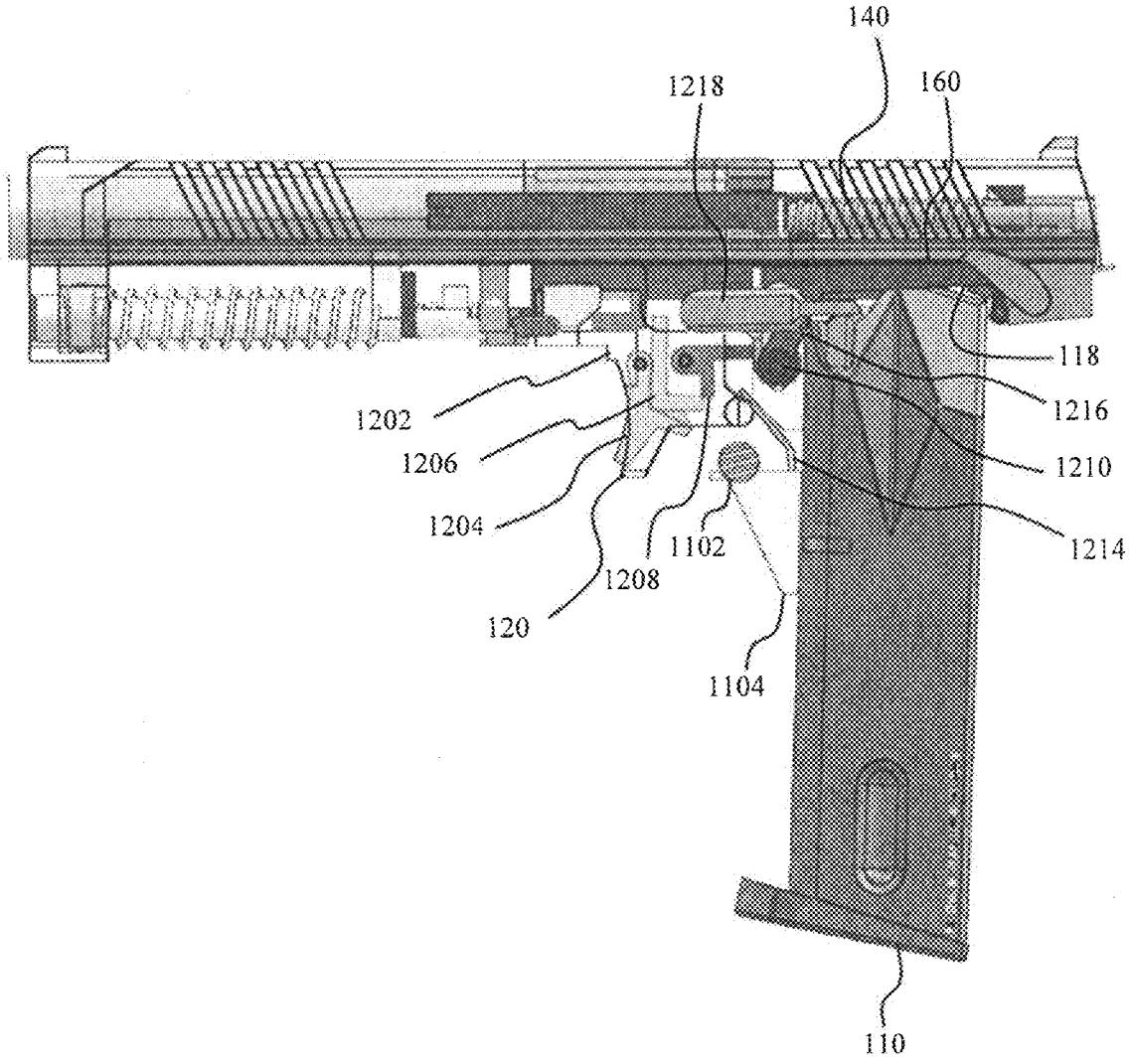
FIG. 5 is a magnified back isometric view of the striker assembly of the pistol illustrating the striker operation, in accordance with an illustrative embodiment.

FIG. 5 is a left side view of a pistol with a backward swept magazine with the frame shown removed to show the internal mechanisms of the pistol, in accordance with one illustrative embodiment.

The pistol magazine assembly comprises a magazine 110, a magazine release button 1102 and a magazine catch 1104.

The pistol 10 comprises a firing mechanism which further comprises a trigger assembly 120, a striker assembly 140 and a release assembly 160. A pull of the trigger 1202 initiates the trigger assembly 120. The trigger assembly 120 transfers the movement of the trigger 1202 to initiate the release mechanism which restrains the striker assembly 140 until initiated by the trigger assembly 120. The striker assembly 140 impacts a chambered cartridge to initiate the primer and start the energetics chain.

The trigger assembly 120 comprises a trigger 1202, a safety lever 1204, a two-position safety interrupter lever 1206 which rotates off of the safety lever 1204, a trigger latch lever 1208, a crosspin 1210, a trigger sear 1212, a trigger return spring 1214 and trigger decocker 1216. The crosspin is located behind the trigger 1202 and holds the vertical drop safety, trigger decocker 1216, and slide hold open lever 118.

The safety lever 1204 extends forward of the trigger 1202 and acts as a safety as the lever must be pressed before the trigger 1202 can be pulled back far enough for the trigger sear 1212 to engage a transfer bar and activate the release assembly 160. After depressing the safety lever 1204, the movement of the safety interrupter lever 1206 which is attached to the safety lever 1204 rotates the trigger latch lever 1208 upwards. The upward rotation of the trigger latch lever 1208 allows the trigger 1202 to continue moving rearward without contacting the crosspin. The rearward translation of the trigger 1202 allows the trigger sear 1212 to contact the transfer bar after it has traveled a short take-up distance. Continued rearward movement of the trigger 1202 will release the striker assembly 140 and raise a vertical drop safety to allow the striker to travel its full distance to fire the weapon.

The trigger sear 1212 is attached to the trigger 1202 and will contact the transfer bar after a short take-up distance. Further trigger movement will cause the transfer bar to move backwards as well and release the striker assembly 140. When the round is fired, the rearward movement of the barrel 106 will cause the trigger sear 1212 to rotate out of line with the transfer bar allowing the striker to be recocked for the next shot. FIG. 13 shows the trigger sear 1212 in the rotated position.

As noted above, the trigger assembly 120 is configured to allow the pistol 10 to operate in a dual mode. In the dual mode, the pistol 10 operates with a longer pull on the first shot, thereby requiring a "heavy" trigger pull. For subsequent shots, the pistol 10 operates as a single action requiring less trigger travel distance and a relatively lighter trigger pull.

The pistol 10 utilizes the trigger latch to transition the pistol 10 from the long action mode to single action mode by keeping the trigger 1202 to the rear. Keeping the trigger 1202 to the rear allows a quicker follow-up shot as the trigger travel distance is less. Upon the first pistol shot, the trigger 1202 is pulled and the trigger assembly 120 operates as described above. When the pistol 10 recoils, the trigger safety interrupter lever 1206 is impacted by the rearward moving transfer bar which causes it to disengage from the trigger latch lever 1208 allowing the latch to catch onto the crosspin. The trigger safety interrupter lever 1206 is a two-position lever and will stay rotated down after being impacted by the transfer bar until a trigger decocker allows the trigger 1202 to transition back to long action mode at which point the forward movement of the trigger 1202 will cause the safety interrupter lever 1206 to cam off the frame 102 back into the up position.

Rotating a slide lock lever 1218 downward will decock the trigger 1202 to the long action mode from single action mode by rotating the crosspin so the trigger latch lever 1208 can no longer hold onto it which allows the trigger return spring to return the trigger 1202 to the forward most position.

The trigger assembly 120 further incorporates a blade safety that is depressed by the user as the trigger 1202 is pulled. This simultaneously deactivates the safety feature to allow the trigger 1202 to fire and lifts an internal latch that holds the trigger 1202 in its single action state for the second shot. At the point just before the trigger assembly 120 releases the striker to fire the round, the trigger 1202 raises the vertical drop safety bock 132 which allows the striker to travel its full distance to fire the weapon.

Figure 6:
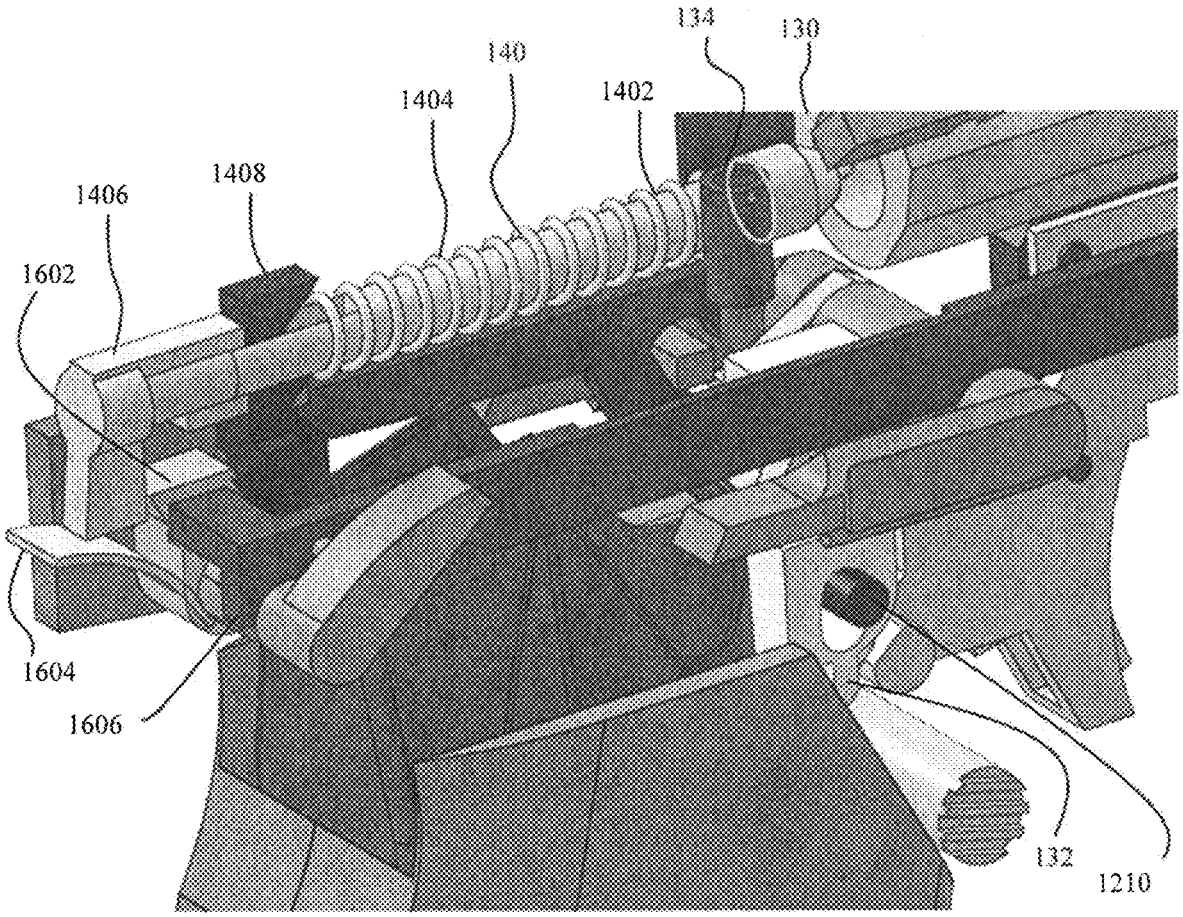
FIG. 6 is a back isometric view of the striker mechanism and striker release assembly 160 of the pistol, in accordance with an illustrative embodiment.
Figure 7:
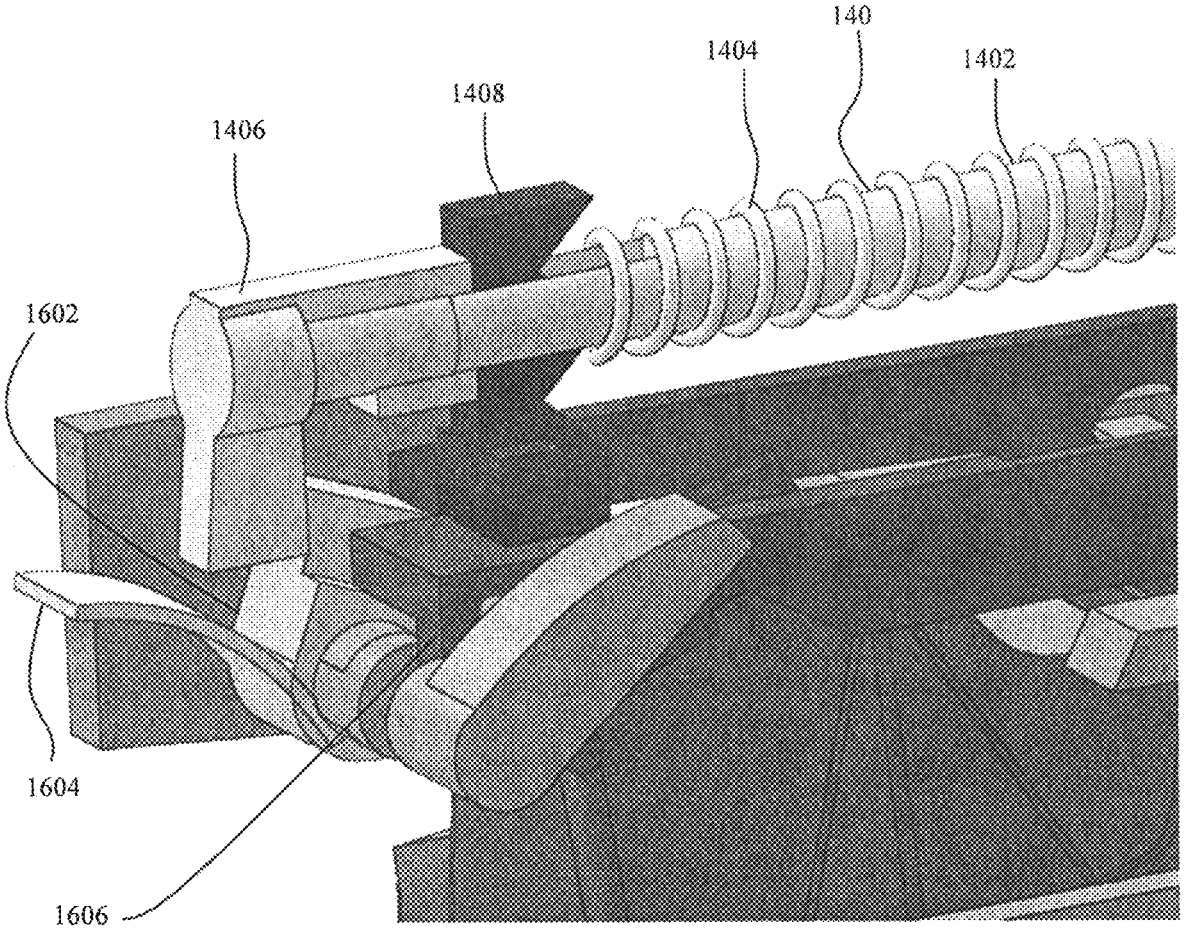
FIG. 7 is a magnified back isometric view of the striker assembly of the pistol illustrating the striker operation, in accordance with an illustrative embodiment.
Figure 8:
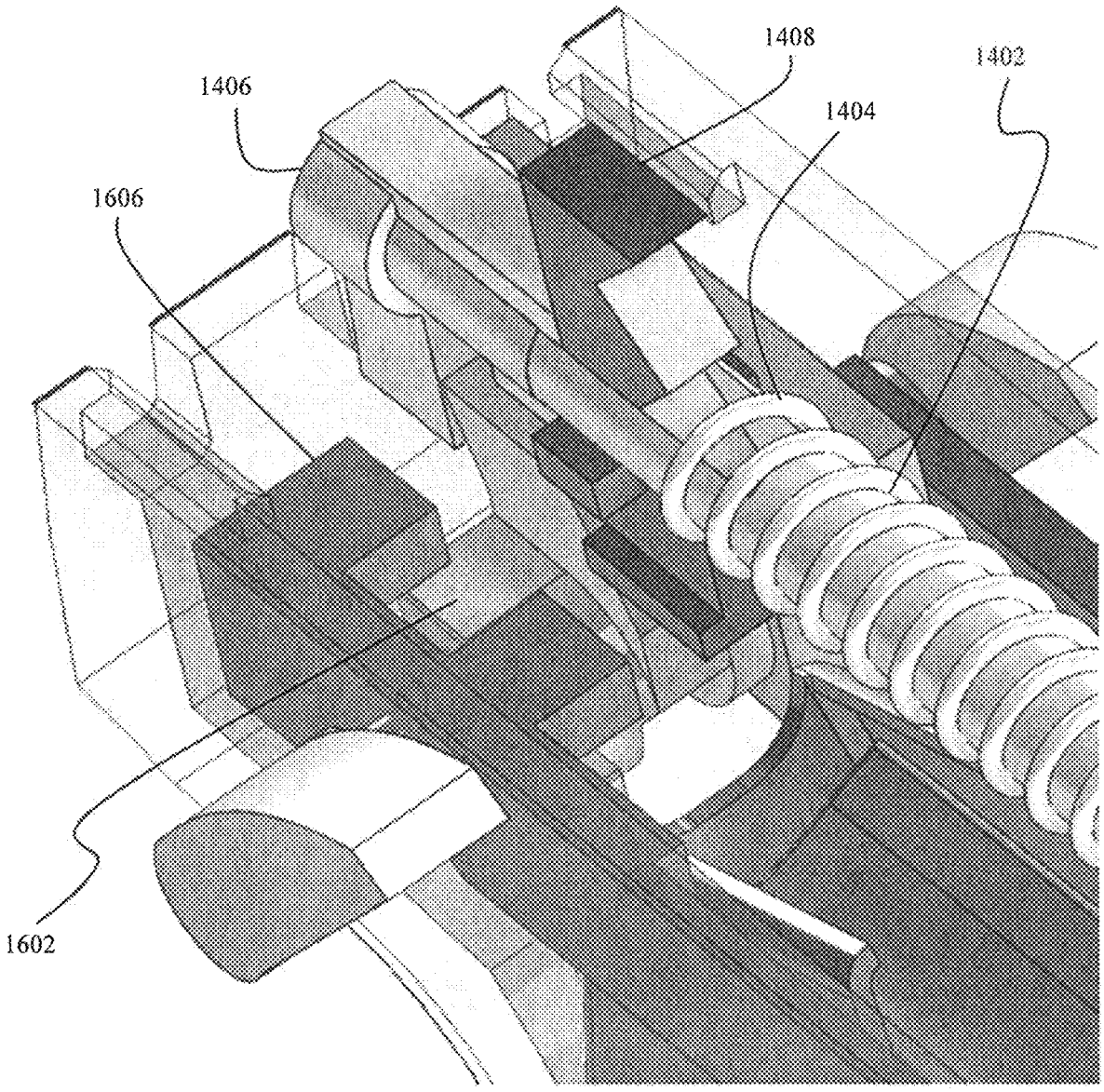
FIG. 8 is a front isometric view of the release assembly of the pistol illustrating the striker operation, in accordance with an illustrative embodiment.
Figure 9:
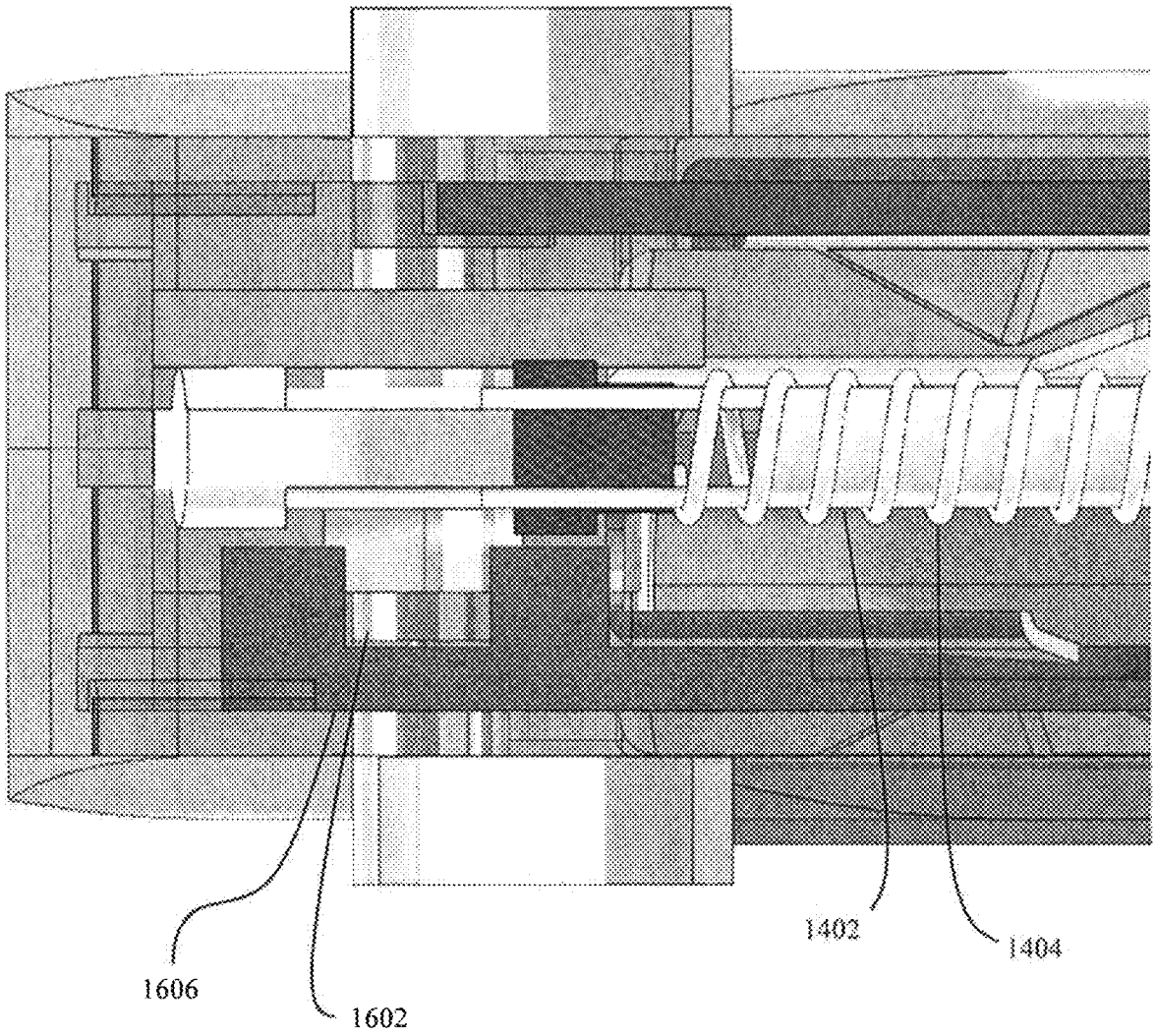
FIG. 9 is a top view of the release assembly of the pistol illustrating the striker operation, in accordance with an illustrative embodiment.

FIG. 6 is a back isometric view of the striker mechanism and striker release assembly 160 of the pistol, in accordance with an illustrative embodiment. FIG. 7 is a magnified back isometric view of the striker assembly of the pistol illustrating the striker operation, in accordance with an illustrative embodiment. FIG. 8 is a front isometric view of the release assembly of the pistol illustrating the striker operation, in accordance with an illustrative embodiment. FIG. 9 is a top view of the release assembly of the pistol illustrating the striker operation, in accordance with an illustrative embodiment.

The striker assembly 140 comprises a striker 1402, a striker spring 1404, a striker base, and a striker disassembly key 1408 which holds the striker assembly 140 in the slide.

The striker 1402 has a generally cylindrical geometry. The forward end of the striker 1402 comprises a pointed conical tip for impacting a primer charge of a chambered cartridge. The striker spring 1404 is coaxial with and surrounds the striker 1402. The striker spring 1404 is maintained under tension and upon release, propels the striker 1402 forward to impact the primer. The striker base 1406 is located at the aft end of the striker 1402 and protrudes downward from the striker 1402. The striker base 1406 interacts with the release assembly 160.

The striker release assembly 160 further comprises a striker roller 1602, a roller return spring 1604, and the transfer bar 1606. The striker roller 1602 interacts with the striker base 1406 extension. The transfer bar 1606 interacts with the trigger assembly 120 and prevents the striker roller 1602 from rotating under the force of the striker spring 1404.

In response to a trigger pull, the trigger assembly 120 engages the transfer bar 1606 which allows the release assembly 160 to release the striker 1402 to strike an ammunition round seated in the chamber 130.

FIG. 8 shows the orientation of the roller mechanism after the trigger has been pulled. When the trigger 1202 is pulled to the rear, the trigger sear 1212 contacts the transfer bar 1606. Further rearward movement of the trigger will cause the transfer bar 1606 to move to the rear as well. The rearward movement of the transfer bar 1606 will allow the striker roller 1602 to rotate. Rotation of the striker roller 1602 disengages the striker roller 1602 from the striker base 1406 thereby disengaging and releasing the striker. The striker 1402 then travels forward under force from the striker spring 1404 to impact the primer on the chambered cartridge and fire the bullet.

Referring back to FIG. 6, in order for the striker 1402 to impact the base of the cartridge, the rearward movement of the trigger also simultaneously displaces the vertical drop safety block 132 and vertical drop safety plunger 134 vertically to allow the striker 1402 to have an uninterrupted path to the cartridge.

Figure 10:
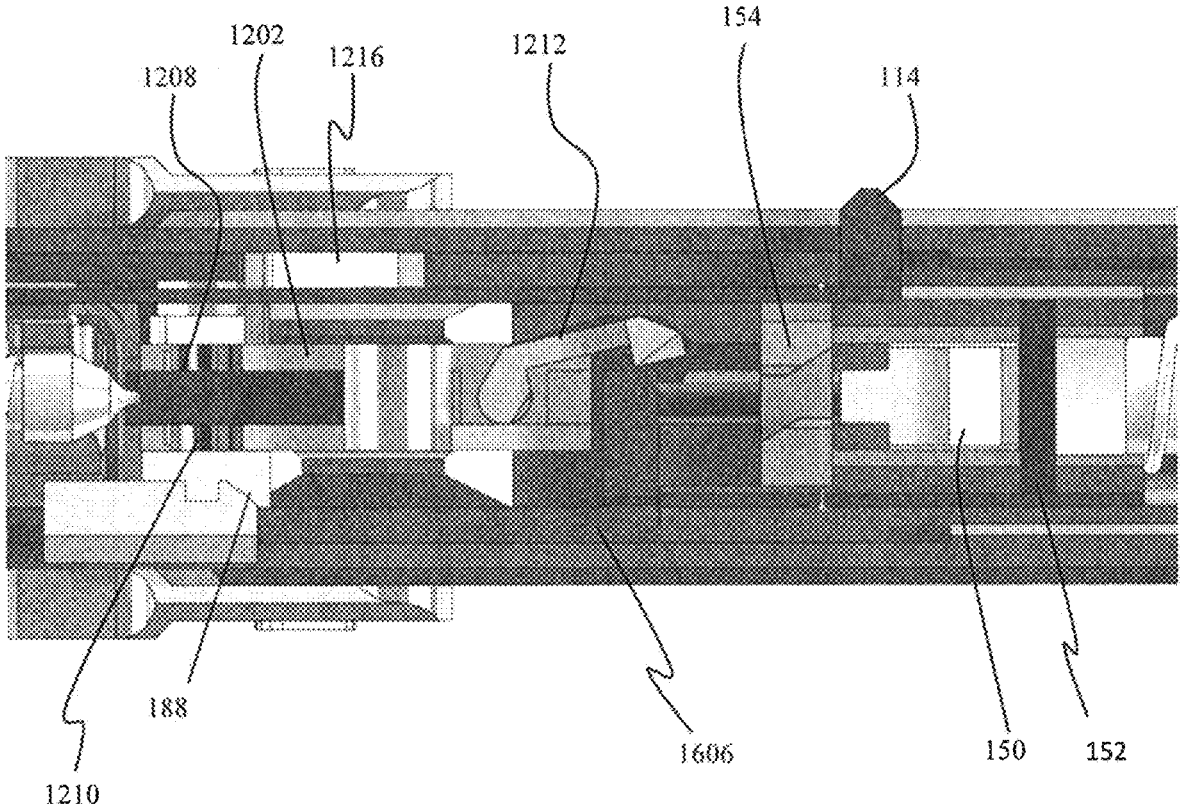
FIG. 10 is a top view of the internal components of the pistol, in accordance with an illustrative embodiment.
Figure 11:
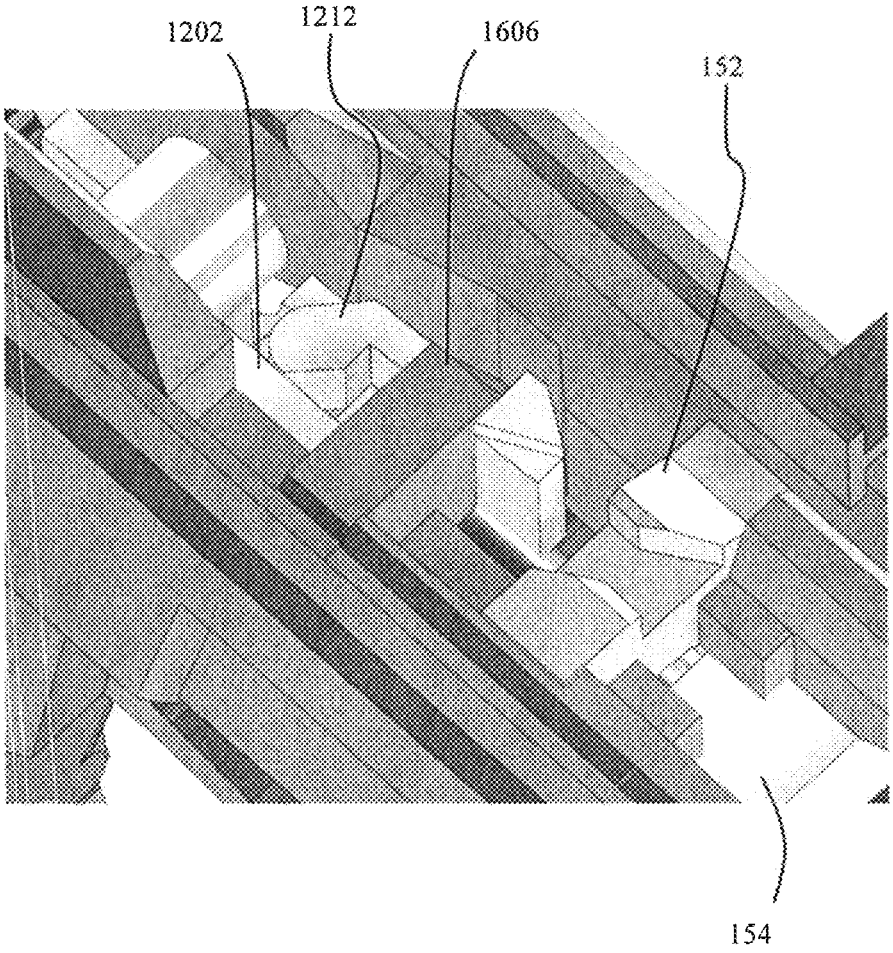
FIG. 11 is a magnified front isometric view of the barrel of the pistol, in accordance with an illustrative embodiment.

FIG. 10 is a top view of the internal components of the pistol, in accordance with an illustrative embodiment. FIG. 11 is a magnified front isometric view of the barrel of the pistol, in accordance with an illustrative embodiment.

The barrel 106 consists of a camming surface and a locking surface as shown in FIG. 4. The camming surface on the barrel 106 interacts with and rotates off of the barrel camming block 152 after an initial horizontal displacement of the barrel 106. Upon firing, the slide moves rearward under recoil and engages with the locking surface on the barrel 106 and both travel together for the initial horizontal displacement. The slide is then disengaged from the barrel 106 when the camming surface of the barrel 106 rotates off the camming surface of the barrel camming block 152. The slide then continues rearward movement to eject and rechamber a new round while the barrel 106 remains in place.

A chamber indicator 114 comprising of a flat spring runs along the left side of the slide as shown in FIG. 14. At the forward most point of the chamber indicator 114 is a tab 1142, or protrusion, that extends out past the outermost wall of the slide when a round is loaded in the chamber, allowing the user to visually and manually determine whether the pistol 10 is loaded. The tab 1142 will only extend past the slide when a round is loaded in the chamber and it is angled in a way that will prevent snagging as the chamber indicator 114 is free to bend inwards despite having a round in the chamber.

To remove the slide from the frame 102, the slide is pulled maximally to the rear and the disassembly button 402 located on the left side of the frame 102 is pressed inward. The motion of the disassembly button 402 simultaneously cams the barrel block depressor 154 forward and engages a notch in the transfer bar 1606 which has been displaced maximally to the rear along with the slide. The forward movement of the barrel block depressor 154 causes the barrel block 150 to move downward and out of line with the barrel cam. As the slide is released and travels forward, the transfer bar 1606 is held in the rear position by the depressed disassembly button 402 which prevents the striker roller 1602 from engaging with the striker base 1406 extension. This allows the slide to be taken off the frame 102 without the need to pull the trigger which serves as a safety feature for this design. The slide can be reasserted onto the frame 102 by simply aligning the rails of the slide with the frame 102 and pulling it to the rear position as the disassembly button 402 will disengage automatically.

While the invention has been described with reference to certain embodiments, numerous changes, alterations and modifications to the described embodiments are possible without departing from the spirit and scope of the invention as defined in the appended claims, and equivalents thereof.

What is claimed is:

1. A locked breech striker-fired pistol comprising:

a barrel having a muzzle end;

a grip extending downward from the barrel in a diagonal direction such that a top end of the grip is forward of a bottom end of the grip;

a magazine well defined by the grip and extending downward from the barrel in a diagonal direction such that a top end of the magazine well is rear of a bottom end of the magazine well, said magazine well being a straight magazine well with an opening partially defined by a bottom surface of the grip;

a trigger assembly positioned forward of the magazine well and proximate to the trigger;

a striker assembly;

a release assembly initiated by the trigger assembly to release the striker assembly; and a slide hold open lever;

wherein the trigger assembly further comprises a crosspin, a vertical drop safety block and a trigger decocker, said crosspin supporting the vertical drop safety block, the trigger decocker and the slide hold open lever.

2. The locked breech striker-fired pistol of claim 1 wherein a longitudinal axis of the magazine well and a longitudinal axis of the barrel form an angle of eighty eight degrees while the locked breech striker-fired pistol is operable.

3. The locked breech striker-fired pistol of claim 1 wherein the trigger assembly further comprises a trigger safety lever concealed substantially within the trigger, a trigger safety interrupter lever aft of and in contact with the trigger safety lever and a trigger latch lever aft of and in contact with the trigger safety interrupter lever wherein a rotation of the trigger safety lever causes a rotation of the trigger safety interrupter lever which further causes a rotation of the trigger latch lever upwards thereby allowing the trigger to be pulled rearward without interference.

4. The locked breech striker-fired pistol of claim 1 wherein the trigger assembly is configured to operate in either a long action mode or a single action mode.

5. The locked breech striker-fired pistol of claim 4 wherein the trigger assembly operates in the long action mode on an initial shot and in the single action mode for subsequent shots until the trigger is returned to an initial position.

6. The locked breech striker-fired pistol of claim 5 wherein upon a recoil of the locked breech striker-fired pistol, a safety interrupter lever is impacted by a rearward moving transfer bar which causes the safety interrupter lever to disengage from a trigger latch lever thereby allowing the trigger latch lever to engage the crosspin and restrict a full return of the trigger.

7. The locked breech striker-fired pistol of claim 6 wherein a trigger safety interrupter lever is a two-position lever which remains in a rotated down position after being impacted by the rearward moving transfer bar until a trigger decocker allows a full return of the trigger.

8. The locked breech striker-fired pistol of claim 7 wherein a rotation of a slide lock lever downward causes the trigger decocker to rotate the crosspin such that a trigger latch lever is disengaged from the crosspin thereby allowing a trigger return spring to fully return the trigger.

9. The locked breech striker-fired pistol of claim 1 wherein the striker assembly further comprises a striker, a striker spring coaxial with and surrounding the striker and a striker base protruding aft of the striker and downward and a striker disassembly key for restraining the striker assembly within a slide of the locked breech striker-fired pistol.

10. The locked breech striker-fired pistol of claim 9 wherein the release mechanism further comprises a striker roller in contact with the striker base and restraining the striker assembly from translating forward in response to a force imparted by the striker spring, a striker roller return spring providing a return force on the striker roller and a transfer bar in contact with the striker roller and restraining the striker roller from rotating under the force of the striker spring.

11. The locked breech striker-fired pistol of claim 10 wherein upon a trigger pull, the transfer bar is engaged and translated rearward by the trigger assembly, a rearward translation of the transfer bar thereby allows the striker roller to rotate and release the striker assembly to translate forward and impact a cartridge.

12. The locked breech striker-fired pistol of claim 11 wherein the trigger assembly simultaneously displaces a vertical drop safety block and a vertical drop safety plunger to allow the striker assembly to have an uninterrupted path to the cartridge.

13. The locked breech striker-fired pistol of claim 10 wherein a slide of the locked breech striker-fired pistol can be removed from a frame of the locked breech striker-fired pistol without pulling the trigger.

14. The locked breech striker-fired pistol of claim 13 wherein the frame further comprises a disassembly button on a side of the frame wherein upon being depressed, the disassembly button engages a notch in the transfer bar and thereby restrains the transfer bar and prevents the striker assembly from striking a cartridge as the slide is released and travels forward.

15. The locked breech striker-fired pistol of claim 14 wherein a depression of the disassembly button simultaneously causes a barrel block depressor to translate forward, a forward translation of the barrel block depressor thereby causing a barrel block to move downward and out of line with a barrel cam.

16. The locked breech striker-fired pistol of claim 1 further comprising a slide and a chamber indicator extending along a side of and partially housed within the slide, the chamber indicator further comprising a flat spring with a tab at a forward most portion of the spring wherein the tab extends beyond a outer surface of the slide when a cartridge is present in a chamber of the locked breech striker-fired pistol.

* * * * *